US009599928B2

(12) United States Patent
Maruyama

(10) Patent No.: US 9,599,928 B2
(45) Date of Patent: Mar. 21, 2017

(54) POWDER TRANSPORT MEMBER, POWDER CONTAINER, AND IMAGE FORMING APPARATUS

(71) Applicant: FUJI XEROX CO., LTD., Tokyo (JP)

(72) Inventor: Akihisa Maruyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/843,451

(22) Filed: Sep. 2, 2015

(65) Prior Publication Data

US 2016/0266515 A1 Sep. 15, 2016

(30) Foreign Application Priority Data

Mar. 12, 2015 (JP) ..... 2015-049978

(51) Int. Cl.
*G03G 15/08* (2006.01)

(52) U.S. Cl.
CPC ..... *G03G 15/0865* (2013.01); *G03G 15/0889* (2013.01); *G03G 15/0872* (2013.01); *G03G 2215/0816* (2013.01)

(58) Field of Classification Search
CPC ..... G03G 15/0832; G03G 15/0839; G03G 15/0865; G03G 15/0889; G03G 15/0891; G03G 2215/085
See application file for complete search history.

(56) References Cited

U.S. PATENT DOCUMENTS 8,588,661 B2 * 11/2013 Ota ..... G03G 15/0875 399/120
2008/0260441 A1 * 10/2008 Takagi ..... G03G 21/12 399/360
2008/0279594 A1 * 11/2008 Sakoh ..... G03G 15/0877 399/262
2008/0279595 A1 * 11/2008 Uezono ..... G03G 15/0855 399/263
2013/0216273 A1 * 8/2013 Koshimori ..... G03G 15/0886 399/262
2014/0029984 A1 * 1/2014 Fujii ..... G03G 15/0865 399/258

FOREIGN PATENT DOCUMENTS

JP 4-358177 A 12/1992

* cited by examiner

*Primary Examiner* — David Gray
*Assistant Examiner* — Carla Therrien
(74) *Attorney, Agent, or Firm* — Sughrue Mion, PLLC

(57) ABSTRACT

A powder transport member includes a rotary member that rotates around an axis inside a container in which powder is contained, a contact member that has one end secured to the rotary member and another end that is a free end, the contact member flexing upon contact of the other end with an inner wall of the container, the contact member having multiple cuts provided in an axial direction of the rotary member, the cuts extending from the other end obliquely with respect to the rotary member, and multiple projections that are provided on the rotary member in the axial direction, the projections projecting from the rotary member toward the inner wall of the container, the projections having a distal end portion that is located at a different position from a starting edge of the cuts with respect to the axial direction.

4 Claims, 10 Drawing Sheets

POWDER TRANSPORT MEMBER, POWDER CONTAINER, AND IMAGE FORMING APPARATUS

CROSS-REFERENCE TO RELATED APPLICATIONS

This application is based on and claims priority under 35 USC 119 from Japanese Patent Application No. 2015-049978 filed Mar. 12, 2015.

BACKGROUND

Technical Field

The present invention relates to a powder transport member, a powder container, and an image forming apparatus.

SUMMARY

According to an aspect of the invention, there is provided a powder transport member including a rotary member that rotates around an axis inside a container in which powder is contained, a contact member that has one end secured to the rotary member and another end that is a free end, the contact member flexing upon contact of the other end with an inner wall of the container, the contact member having multiple cuts provided in an axial direction of the rotary member, the cuts extending from the other end obliquely with respect to the rotary member, and multiple projections that are provided on the rotary member in the axial direction, the projections projecting from the rotary member toward the inner wall of the container, the projections having a distal end portion that is located at a different position from a starting edge of the cuts with respect to the axial direction.

BRIEF DESCRIPTION OF THE DRAWINGS

Exemplary embodiment of the present invention will be described in detail based on the following figures, wherein.

DETAILED DESCRIPTION

An example of a powder transport member, a powder container, and an image forming apparatus according to an exemplary embodiment of the present invention will be described with reference to FIGS. 1 to 9. In the figures, an arrow Y indicates the vertical direction and the height direction of the apparatus, an arrow X indicates the horizontal direction and the width direction of the apparatus, and an arrow Z indicates the horizontal direction and the depth direction of the apparatus.

(General Configuration)

Figure 9:
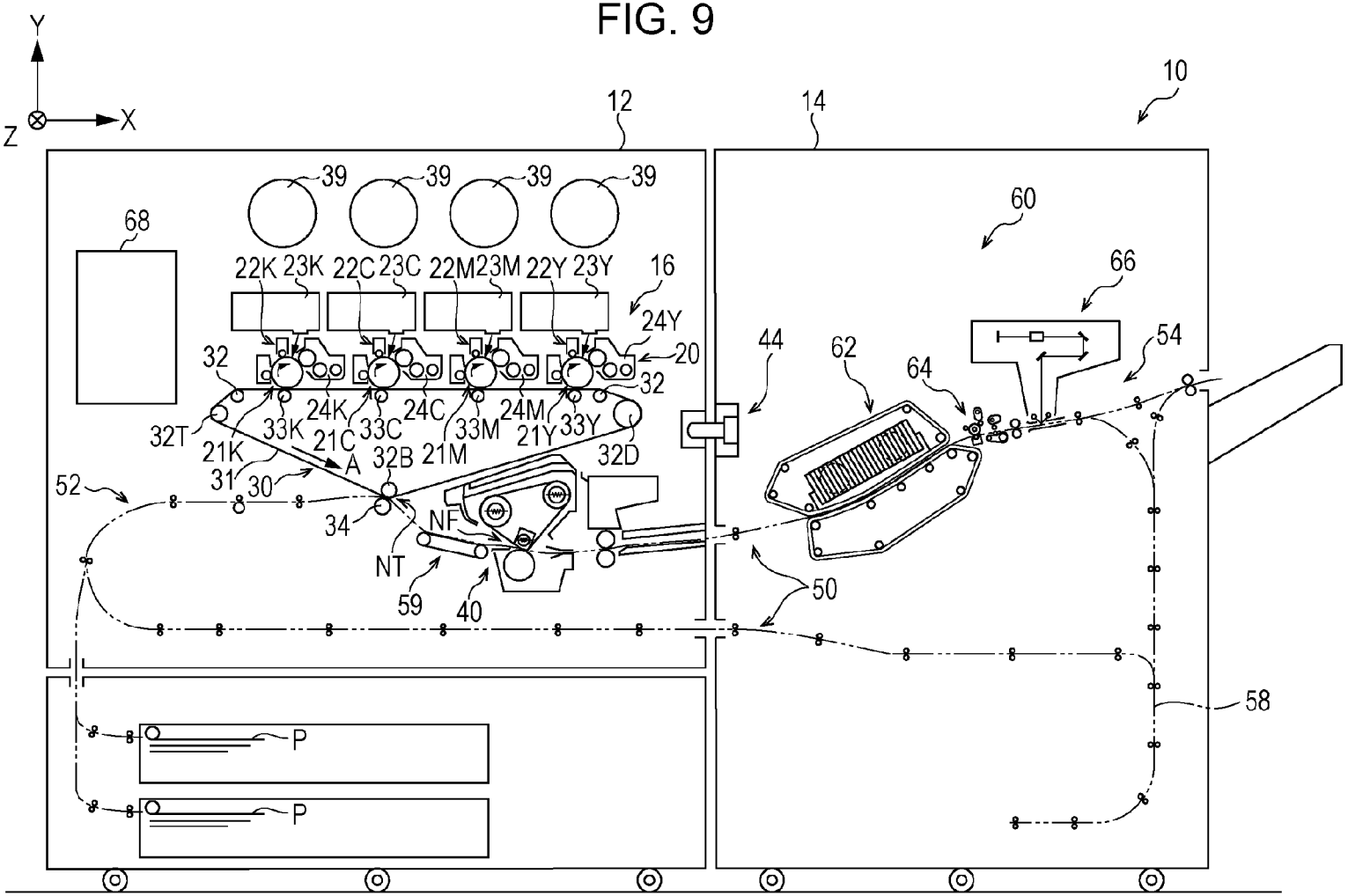
FIG. 9 is a schematic diagram illustrating the image forming apparatus according to the exemplary embodiment of the present invention.

As illustrated in FIG. 9, an image forming apparatus 10 includes a first housing 12, a second housing 14, an image forming part 16, a medium transport part 50, a post-processing part 60, and a controller 68. The controller 68 controls various components of the image forming apparatus 10 (such as various components of the image forming part 16).

The first housing 12 and the second housing 14 are disposed side by side in the width direction of the image forming apparatus, and coupled to each other by a coupling mechanism 44.

[Image Forming Part 16]

Figure 8:
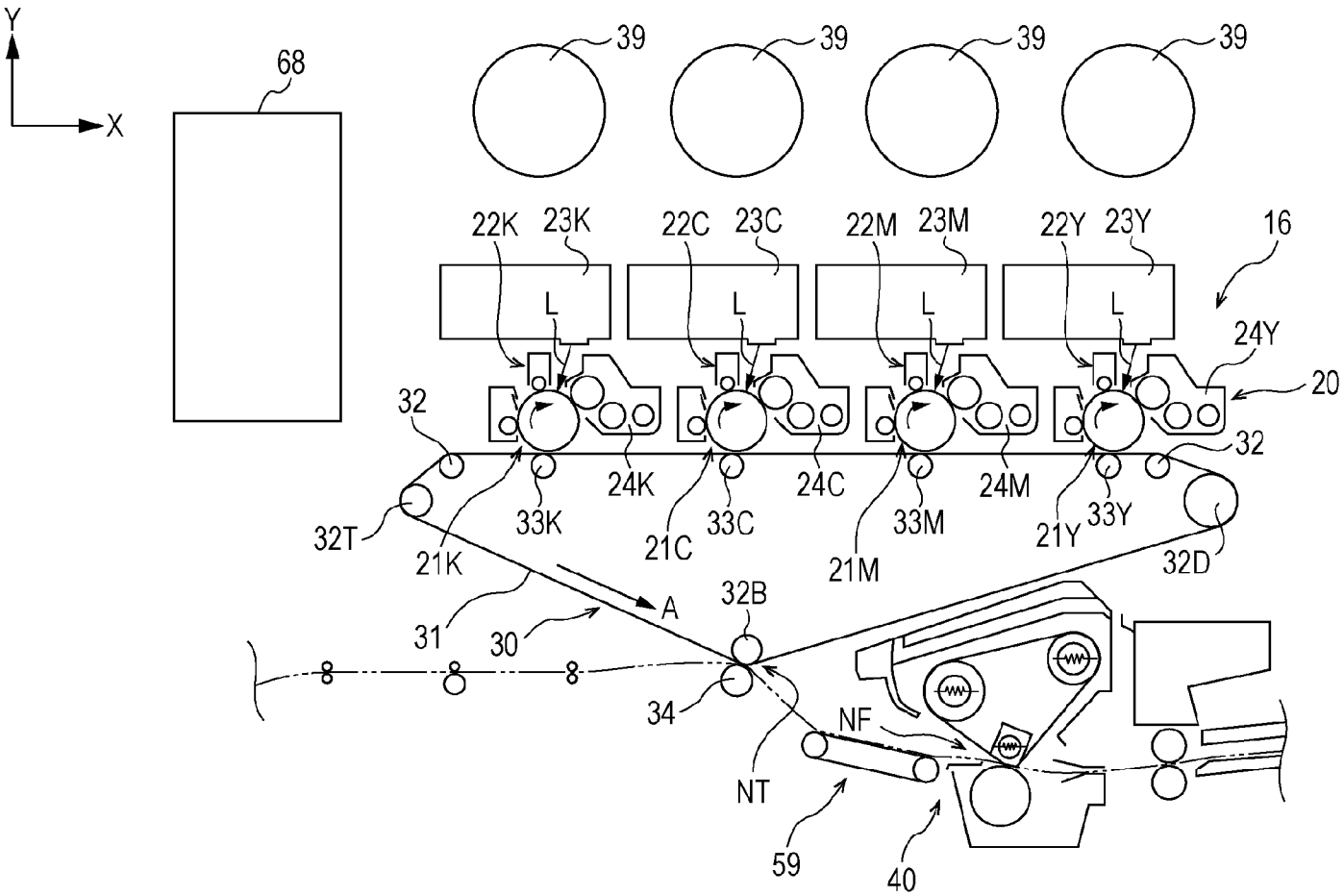
FIG. 8 is a diagram illustrating components such as an image forming part of an image forming apparatus according to the exemplary embodiment of the present invention.

The image forming part 16 is disposed inside the first housing 12. As illustrated in FIG. 8, the image forming part 16 includes a toner image forming part 20 that forms a toner image, a transfer device 30 that transfers the image formed by the toner image forming part 20 to a sheet member P (see FIG. 9) that is an example of a recording medium, and a fixing device 40 that fixes the toner image transferred to the sheet member P onto the sheet member P. The image forming part 16 forms an image on the sheet member P by an electrophotographic system.

[Toner Image Forming Part 20]

The toner image forming part 20 includes a photoconductor drum 21 that is an example of an image carrier, a charging unit 22, an exposure device 23, and a developing device 24. The toner image forming part 20 includes multiple image forming parts for individually forming toner images of different colors. In the exemplary embodiment, the toner image forming part 20 includes toner image forming parts for forming a total of four colors, yellow (Y), magenta (M), cyan (C), and black (K). The toner image forming parts 20 for the individual colors have the same structure. The toner image forming parts 20 for the individual colors are disposed so that in the direction in which a transfer belt 31 provided in the transfer device 30 revolves, the respective photoconductor drums 21 of the toner image forming parts 20 contact the transfer belt 31 in order of yellow (Y), magenta (M), cyan (C), and black (K) from the upstream side. The toner image forming parts 20 for the individual colors are disposed side by side in the width direction of the apparatus. In the following description, reference signs Y, M, C, and K will be sometimes omitted when it is unnecessary to distinguish between Y, M, C, and K.

The photoconductor drum 21, which has a cylindrical shape, is driven by a driving component (not illustrated) so as to rotate about its own axis. The outer peripheral surface of the photoconductor drum 21 is provided with, for example, a photosensitive layer that is charged to negative polarity. The outer peripheral surface of the photoconductor drum 21 may be provided with an overcoat layer.

The charging unit 22, which contacts the outer peripheral surface (photosensitive layer) of the photoconductor drum 21, rotates in response to rotation of the photoconductor drum 21 to charge the outer peripheral surface of the photoconductor drum 21 to negative polarity.

The exposure device 23 forms an electrostatic latent image on the outer peripheral surface of the photoconductor drum 21. Specifically, in accordance with image data received from an image signal processor constituting the controller 68, the exposure device 23 irradiates the outer peripheral surface of the photoconductor drum 21 charged by the charging unit 22 with modulated exposure light L. An electrostatic latent image is formed on the outer peripheral surface of the photoconductor drum 21 through this irradiation with the exposure light L.

In the exemplary embodiment, the exposure device 23 performs exposure on the outer peripheral surface of the photoconductor drum 21 by scanning a light beam applied from a light source (not illustrated) across the outer peripheral surface by a light scanning component (optical system) including a polygon mirror and an F-theta lens.

The developing device 24 develops the electrostatic latent image formed on the outer peripheral surface of the photoconductor drum 21 with a developer including a toner T (an example of powder) and a carrier, thus forming a toner image on the outer peripheral surface of the photoconductor drum 21. A powder container 39 (toner cartridge) for replenishing the developing device 24 with the toner T is connected to the developing device 24 via a transport path (not illustrated). The powder containers 39 for the individual colors, which are disposed side by side in the apparatus width direction above the corresponding exposure devices 23, are individually mounted on the first housing 12 in a manner that allows their detachment (replacement). The powder container 39 will be described later in detail.

The transfer device 30 includes the transfer belt 31 that is in the form of an endless belt to which a toner image on the photoconductor drum 21 for each individual color is transferred. The position of the transfer belt 31 is determined as the transfer belt 31 is wound around multiple rollers 32. In the exemplary embodiment, the transfer belt 31 is placed in such a position that the transfer belt 31 forms an inverted obtuse triangle that is elongated in the apparatus width direction as viewed from the front side.

Of the multiple rollers 32, a roller 32D serves as a drive roller that causes the transfer belt 31 to revolve in the direction of an arrow A with power supplied from a motor (not illustrated). Of the multiple rollers 32, a roller 32T serves as a tension applying roller that applies tension to the transfer belt 31. Of the multiple rollers 32, a roller 32B serves as an opposed roller that is opposed to a second transfer roller 34 described later.

Further, a first transfer roller 33 is disposed opposite to the photoconductor drum 21 for each individual color across the transfer belt 31. The first transfer roller 33 transfers a toner image formed on the outer peripheral surface of the photoconductor drum 21 to the transfer belt 31.

Further, the second transfer roller 34 is in contact with the obtuse apex at the lower end side of the transfer belt 31. The second transfer roller 34 transfers a toner image transferred to the transfer belt 31 to the sheet member P. A transfer nip NT is formed by the transfer belt 31 and the second transfer roller 34.

The fixing device 40 fixes a toner image transferred to the sheet member P by the transfer device 30, onto the sheet member P. In the exemplary embodiment, the fixing device 40 fixes a toner image onto the sheet member P by applying heat and pressure to the toner image at a fixing nip NF.

[Medium Transport Part 50]

As illustrated in FIG. 9, the medium transport part 50 includes a medium supply part 52 that supplies the sheet member P to the image forming part 16, and a medium discharge part 54 that discharges the sheet member P on which an image has been formed. Further, the medium transport part 50 includes a medium return part 58 used when an image is to be formed on both sides of the sheet member P, and an intermediate transport part 59 that transports the sheet member P from the transfer device 30 to the fixing device 40.

The medium supply part 52 supplies the sheet member P sheet by sheet to the transfer nip NT of the image forming part 16 in synchronism with the transfer timing. The medium discharge part 54 discharges the sheet member P with a toner image fixed thereon by the fixing device 40, to the outside of the apparatus. Further, the medium return part 58 reverses the front and back of the sheet member P and returns the sheet member P to the image forming part 16 (the medium supply part 52), when an image is to be formed on the other side of the sheet member P with a toner image already fixed on one side.

[Post-Processing Part 60]

As illustrated in FIG. 9, the post-processing part 60, which is disposed inside the second housing 14, includes a medium cooling part 62 that cools the sheet member P on which an image has been formed, a straightening device 64 that straightens curving of the sheet member P, and an image inspection part 66 that inspects an image.

The constituent parts of the post-processing part 60 are disposed within the medium discharge part 54 of the medium transport part 50 in order of the medium cooling part 62, the straightening device 64, and the image inspection part 66, from the upstream side in the discharge direction of the sheet member P.

(Image Forming Operation)

The following description provides an overview of an image forming process for forming an image on the sheet member P, and a post-processing process which are performed by the image forming apparatus 10.

Upon receiving an instruction to form an image, the controller 68 activates the toner image forming part 20, the transfer device 30, and the fixing device 40. Thus, the photoconductor drum 21, and a developing roller (reference sign omitted) provided in the developing device 24 are rotated, causing the transfer belt 31 to revolve. Further, a pressure roller (reference sign omitted) is rotated, and a fixing belt (reference sign omitted) is caused to revolve.

Then, the controller 68 activates components such as the medium transport part 50 in synchronism with these operations.

Thus, the photoconductor drum 21 for each individual color is charged by the charging unit 22 while rotating. The controller 68 sends image data to which image processing has been applied in the image signal processor, to the exposure device 23 for each individual color. The exposure device 23 for each individual color emits exposure light L for each individual color in accordance with the image data, thereby exposing the charged photoconductor drum 21 for each individual color to the corresponding exposure light L. Thus, an electrostatic latent image is formed on the outer peripheral surface of the photoconductor drum 21 for each individual color. The electrostatic latent image formed on the photoconductor drum 21 for each individual color is developed as a toner image with developer supplied from the developing device 24. As a result, a toner image in one of the colors yellow (Y), magenta (M), cyan (C), and black (K) is formed on the photoconductor drum 21 for the corresponding color.

Further, each of the toner images of the individual colors formed on the photoconductor drums 21 for the individual colors is sequentially transferred by the first transfer roller 33 for the corresponding color to the transfer belt 31 that revolves. Thus, a toner image obtained by superimposing the toner images of four colors on one another is formed on the transfer belt 31. This toner image is transported to the transfer nip NT as the transfer belt 31 revolves. The sheet member P is supplied to the transfer nip NT by the medium supply part 52 in synchronism with the transport of this toner image. Application of a transfer bias voltage at the transfer nip NT causes the toner image to be transferred from the transfer belt 31 to the sheet member P.

The sheet member P with the transferred toner image is transported from the transfer nip NT of the transfer device 30 toward the fixing nip NF of the fixing device 40 while being sucked under negative pressure by the intermediate transport part 59. The fixing device 40 applies heat and pressure (fixing energy) to the sheet member P passing through the fixing nip NF. Thus, the toner image transferred to the sheet member P is fixed onto the sheet member P.

After being discharged from the sheet member P, the sheet member P is subjected to processing by the post-processing part 60 while being transported by the medium discharge part 54 toward a discharged medium receiving part located outside the apparatus. The sheet member P heated by the fixing device 40 is first cooled in the medium cooling part 62. Next, curving of the sheet member P is straightened by the straightening device 64. Further, the toner image fixed on the sheet member P is inspected by the image inspection part 66 for the presence or degree of defects such as a toner density defect, an image defect, and an image position defect. Then, the sheet member P is discharged to the outside of the second housing 14 by the medium discharge part 54.

When an image is to be formed on the non-image side (back side) of the sheet member P on which an image has not been formed (that is, in the case of duplex printing), the controller 68 changes the transport path along which to transport the sheet member P that has passed through the image inspection part 66, from the medium discharge part 54 to the medium return part 58. Thus, the front and back of the sheet member P are reversed, and then the sheet member P is sent to the medium supply part 52. An image is formed (fixed) on the back side of the sheet member P through a process similar to that mentioned above. The resulting sheet member P is discharged to the outside of the second housing 14 by the medium discharge part 54.

(Configuration of Major Portion)

Next, the powder container 39 according to the exemplary embodiment will be described.

Figure 4:
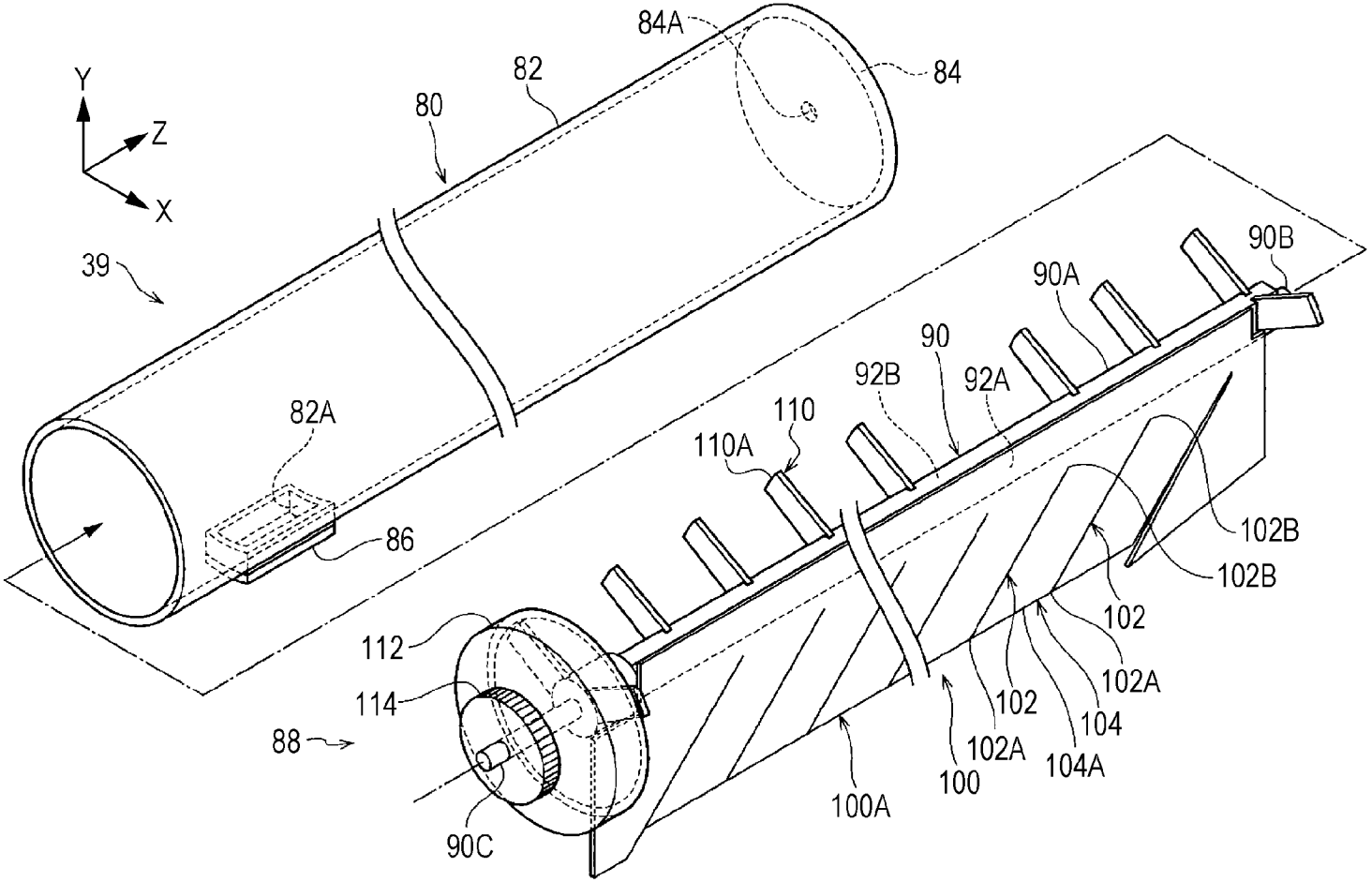
FIG. 4 is an exploded perspective view of the powder transport member and the powder container according to the exemplary embodiment of the present invention.
Figure 5:
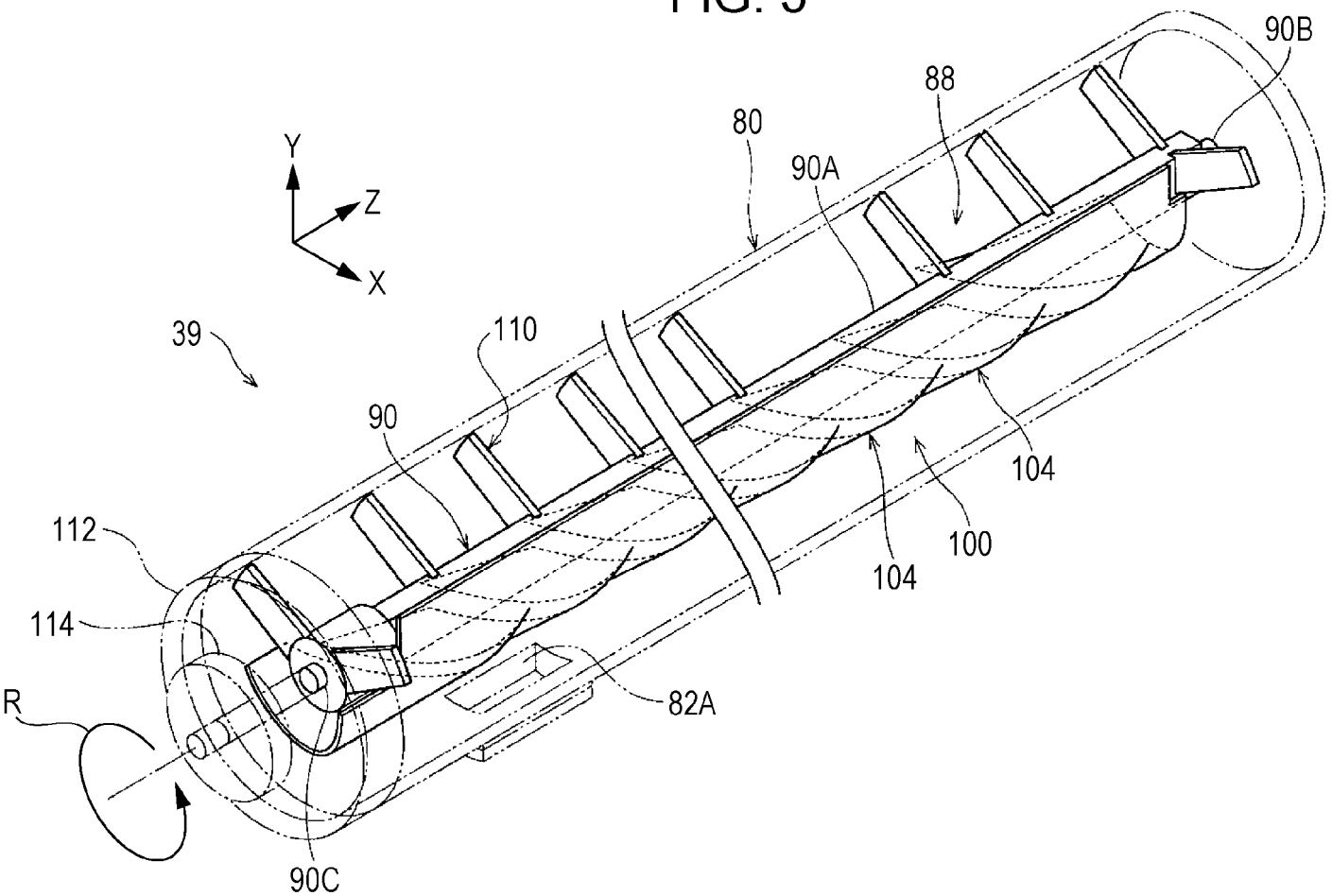
FIG. 5 is a perspective view of the powder transport member according to the exemplary embodiment of the present invention.

The powder container 39 is detachably mounted on the first housing 12. As illustrated in FIGS. 4 and 5, the powder container 39 includes a container body 80, and a powder transport member 88 disposed inside the container body 80.

[Container Body 80]

Figure 1:
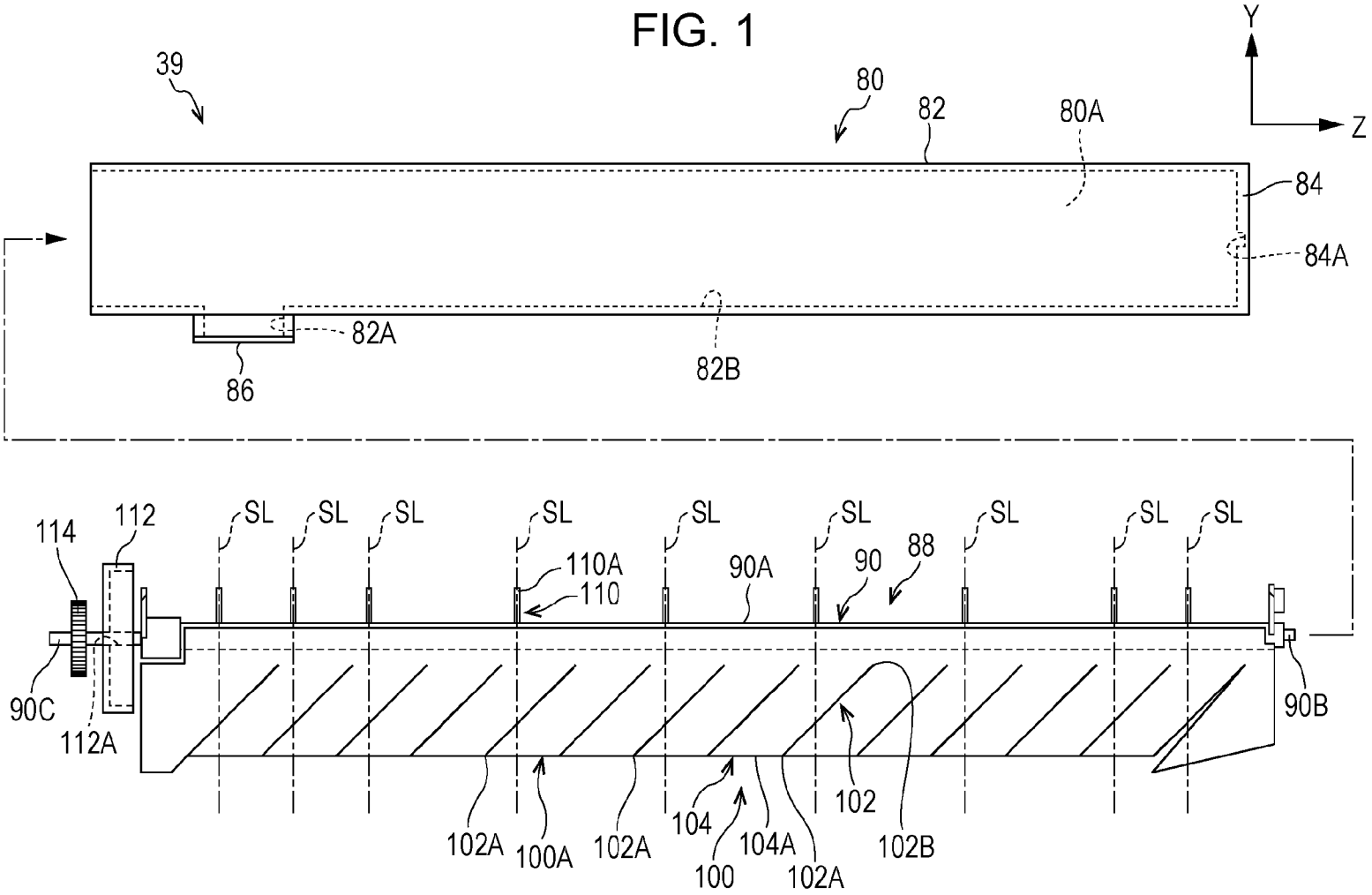
FIG. 1 is an exploded side view of a powder transport member and a powder container according to an exemplary embodiment of the present invention.

As illustrated in FIGS. 1 and 4, the container body 80 has a cylindrical part 82 formed in the shape of a cylinder extending in the apparatus depth direction, and a closing part 84 that closes the front side in the apparatus depth direction (to be sometimes referred to simply as "upstream side in the toner transport direction" hereinafter) of the cylindrical part 82. The interior of the container body 80 defines a containing part 80A. The containing part 80A is a cylindrical space in which the toner T (an example of powder) is contained and which extends in the apparatus depth direction.

Further, a discharge opening 82A is provided at the back side in the apparatus depth direction (to be sometimes referred to simply as "downstream side in the toner transport direction" hereinafter) of the cylindrical part 82. The toner T contained in the containing part 80A is discharged through the discharge opening 82A to a transport path (not illustrated) connected to the developing device 24. The discharge opening 82A, which is located so as to discharge the toner T downward, has a rectangular shape as viewed in the direction of discharge of the toner T.

An opening and closing cover 86 is attached over the discharge opening 82A to open or close the discharge opening 82A. In a state in which the powder container 39 is detached from the first housing 12, the urging force of an urging member (not illustrated) causes the opening and closing cover 86 to be placed in a close position that closes the discharge opening 82A. Upon mounting the powder container 39 on the first housing 12, the opening and closing cover 86 is pushed by a protrusion (not illustrated), causing the opening and closing cover 86 to move to an open position that opens the discharge opening 82A.

The closing part 84 is disc-shaped. The closing part 84 has a recess 84A located substantially at its center. A shaft part 90B of a rotary shaft 90 constituting the powder transport member 88 is supported in the recess 84A via a bearing (not illustrated).

[Powder Transport Member 88]

The powder transport member 88 includes the rotary shaft 90, a transport member 100, and multiple agitating parts 110. The rotary shaft 90 is disposed inside the container body 80 constituting the powder container 39. The transport member 100 is an example of a film-like contact member extending from the outer periphery of the rotary shaft 90 toward the inner periphery of the container body 80. The agitating parts 110 are an example of projections that project from the outer periphery of the rotary shaft 90 toward the inner periphery of the container body 80.

<Rotary Shaft 90>

As illustrated in FIGS. 1 and 4, the rotary shaft 90 has a rectangular part 90A, the shaft part 90B, and a shaft part 90C. The rectangular part 90A extends in the apparatus depth direction and has a rectangular shape in section. The shaft part 90B, whose proximal end is secured on the upstream side in the toner transport direction of the rectangular part 90A, extends in the apparatus depth direction and has a cylindrical shape. The shaft part 90C, whose proximal end is secured on the downstream side in the toner transport direction of the rectangular part 90A, extends in the apparatus depth direction and has a cylindrical shape. The shaft part 90B is supported in the recess 84A of the closing part 84 via a bearing (not illustrated), and the shaft part 90C penetrates a through-hole 112A of a closing member 112 described later. Thus, the rotary shaft 90 is supported so as to be rotatable about an axis extending in the apparatus depth direction. The rotary shaft 90 according to the exemplary embodiment is an example of a rotary member.

<Transport Member 100>

The transport member 100 is made of a resin film having flexibility (for example, a PET film). The thickness of the resin film is, for example, 100 [μm]. As illustrated in FIGS. 1 and 4, the proximal end (one end) of the transport member 100 is attached to a side face 92A constituting the rectangular part 90A of the rotary shaft 90 by a securing component (not illustrated). When in its developed state with the rotary shaft 90 not being attached to the container body 80, the transport member 100 has a substantially rectangular shape extending in the apparatus depth direction. In a state in which the transport member 100 with its proximal end being attached to the rotary shaft 90 is disposed inside the containing part 80A, the distal end (other end) of the transport member 100 is in contact with an inner wall 82B constituting the containing part 80A, causing the transport member 100 to flex into a curved shape as viewed in the apparatus depth direction (see FIGS. 5, 7A, 7B, and 7C).

Figure 6:
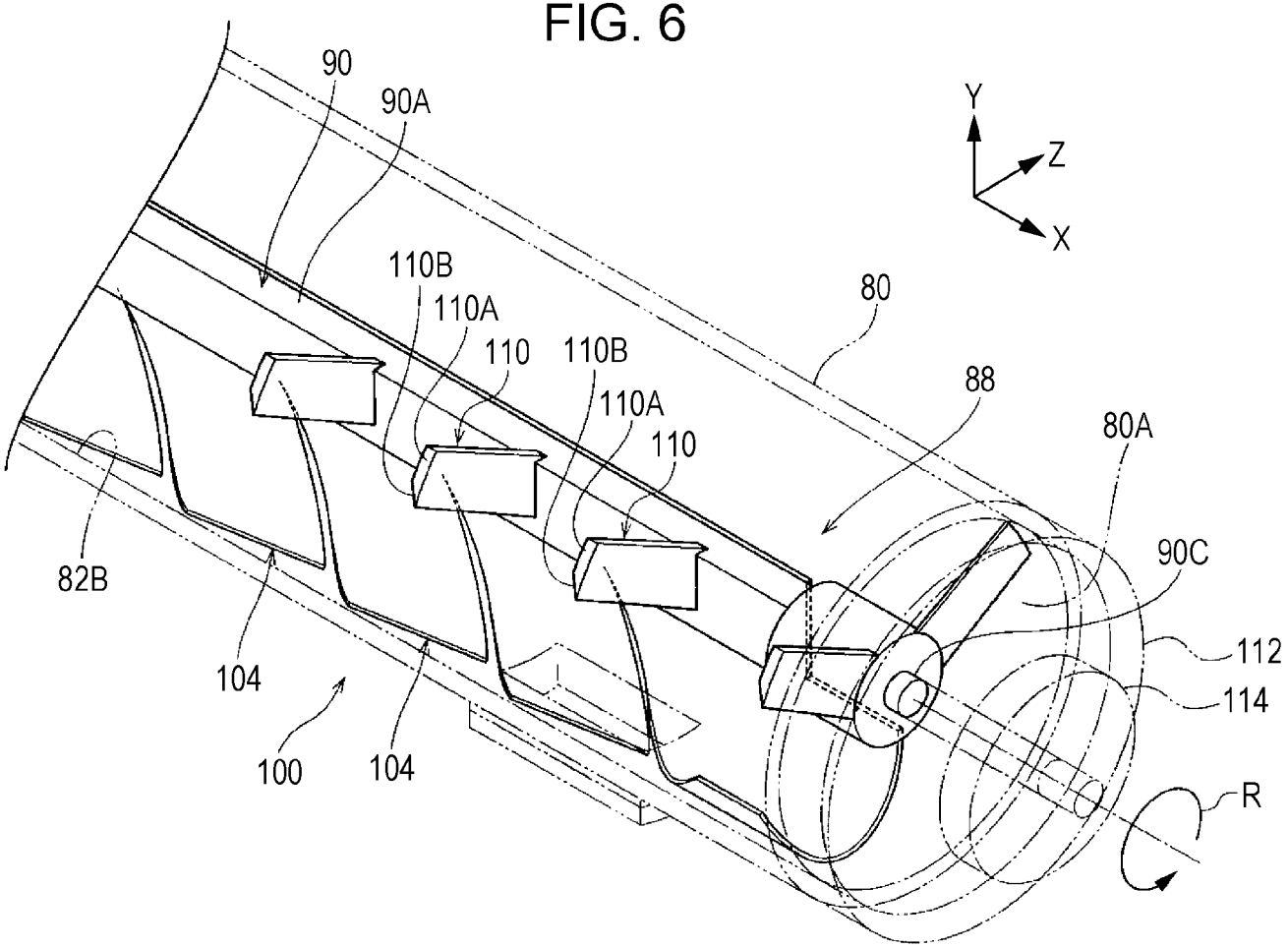
FIG. 6 is a perspective view illustrating a flexing state of the contact member of the powder transport member according to the exemplary embodiment of the present invention.

As illustrated in FIG. 1, in the transport member 100, multiple slits 102 are provided with spacing (regular spacing in the exemplary embodiment) in the axial direction of the rotary shaft 90 (which is the same as the apparatus depth direction in the present example), as an example of cuts extending from the distal end of the transport member 100 toward the rotary shaft 90 obliquely with respect to the rotational direction of the rotary shaft 90 (direction indicated by an arrow R in FIGS. 5 and 6). Specifically, the slits 102 are inclined with respect to the rotational direction of the rotary shaft 90 so that, when the transport member 100 is in its developed state, a starting edge 102A of the slits 102 is located on the downstream side in the toner transport direction with respect to an end edge 102B. Hereinafter, the part formed between each two adjacent slits 102 of the transport member 100 will be referred to as a vane part 104. Multiple vane parts 104 are provided side by side in the apparatus depth direction.

Further, the slits 102 are provided in the transport member 100 in such a way that each two adjacent slits 102 partially overlap with respect to the rotational direction of the rotary shaft 90. Specifically, each two adjacent slits 102 overlap with respect to the rotational direction of the rotary shaft 90 by less than half of their area with respect to the axial direction of the rotary shaft 90.

<Agitating Parts 110>

The multiple agitating parts 110 are provided on the rotary shaft 90 with spacing in the axial direction of the rotary shaft 90. The agitating parts 110, which are rod-shaped, project in the radial direction of the rotary shaft 90 (to be sometimes referred to simply as "radial direction" hereinafter) from a side face 92B of the rectangular part 90A which is located opposite to the side face 92A. A distal end portion 110A of all of the agitating parts 110 is located at a different position from the starting edge 102A of the slits 102 with respect to the axial direction of the rotary shaft 90. That is, the agitating parts 110 are all provided on the rotary shaft 90 in such a way that their distal end portion 110A is located at a different position from the starting edge 102A of the slits 102 with respect to the axial direction of the rotary shaft 90. Specifically, as illustrated in FIG. 1, the agitating parts 110 are disposed on the rotary shaft 90 so that the starting edge 102A of the slits 102 does not lie on a straight line SL running along the rotational direction of the rotary shaft 90 and passing through the distal end portion 110A of the agitating parts 110.

In particular, in the exemplary embodiment, the agitating parts 110 are disposed so that the distal end portion 110A of the agitating parts 110 and the middle part in the extending direction of the slits 102 are located at the same position with respect to the axial direction of the rotary shaft 90. The expression "the middle part in the extending direction of the slits 102" as used herein refers to an area within a range of 15% of the length XL of the slits 102 from the center in the extending direction of the slits 102. Further, the extending direction of the slits 102 refers to the direction oriented from the starting edge 102A toward the end edge 102B.

Further, an end face 110B of the agitating parts 110, which is located at the downstream side in the rotational direction of the rotary shaft 90, is inclined with respect to the rotational direction of the rotary shaft 90. Specifically, because the end face 110B is inclined as described above when the agitating parts 110 are viewed in section along a direction orthogonal to the extending direction of the agitating parts 110, the agitating parts 110 have a pointed end portion at the downstream side in the rotational direction of the rotary shaft 90. When the rotary shaft 90 rotates, the agitating parts 110 also rotate, and the toner T contained in the containing part 80A is agitated by the agitating parts 110 (see FIGS. 3 and 6).

As illustrated in FIG. 1, the spacing between the agitating parts 110 disposed on the rotary member 90 is narrower at both end portions in the axial direction of the rotary shaft 90 than in the middle part. Arranging the agitating parts 110 with such spacing allows the toner T to be efficiently agitated by the agitating parts 110 even when the toner T is unevenly distributed toward one side (end portion) inside the powder container 39. This allows the powder transport member 88 to be rotated even when the toner T is unevenly distributed toward the end portion inside the powder container 39.

The following provides a description of how the toner T is transported by the vane parts 104 of the powder transport member 88.

Figure 7A:
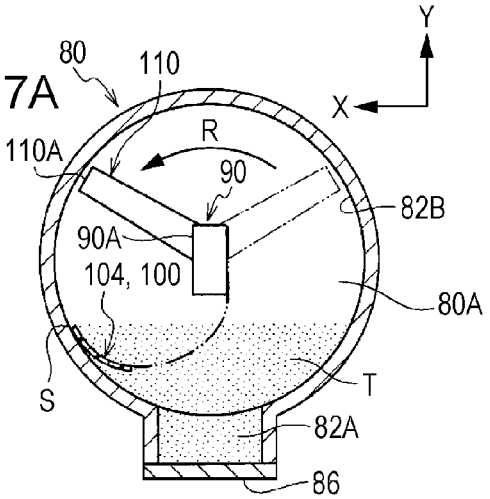
FIG. 7A is a sectional view taken along a line VIIA-VIIA of FIG. 2.
Figure 7B:
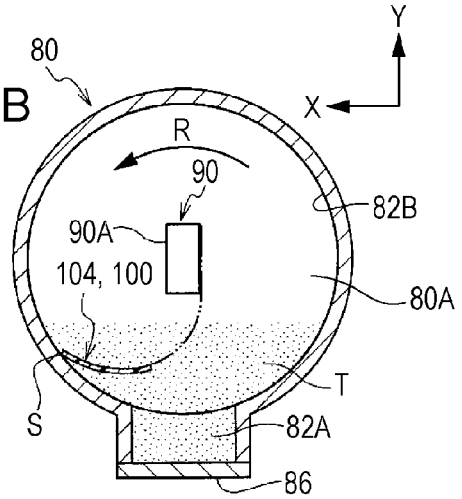
FIG. 7B is a sectional view taken along a line VIIB-VIIB of FIG. 2.
Figure 7C:
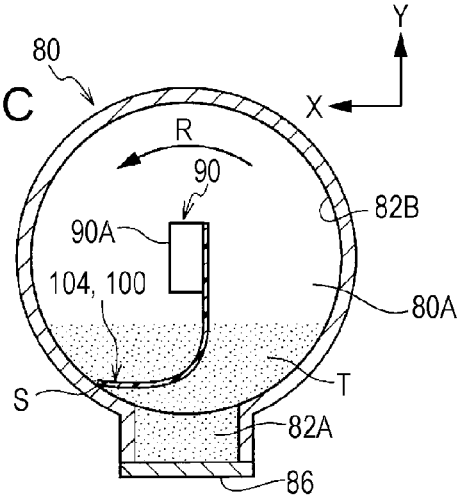
FIG. 7C is a sectional view taken along a line VIIC-VIIC of FIG. 2.

As illustrated in FIGS. 7A, 7B, and 7C, a distal end 104A (a part of a distal end 100A of the transport member 100) of the vane part 104 is in contact with the inner wall 82B constituting the containing part 80A, which causes the vane part 104 to flex into a curved shape as viewed in the apparatus depth direction.

Figure 2:
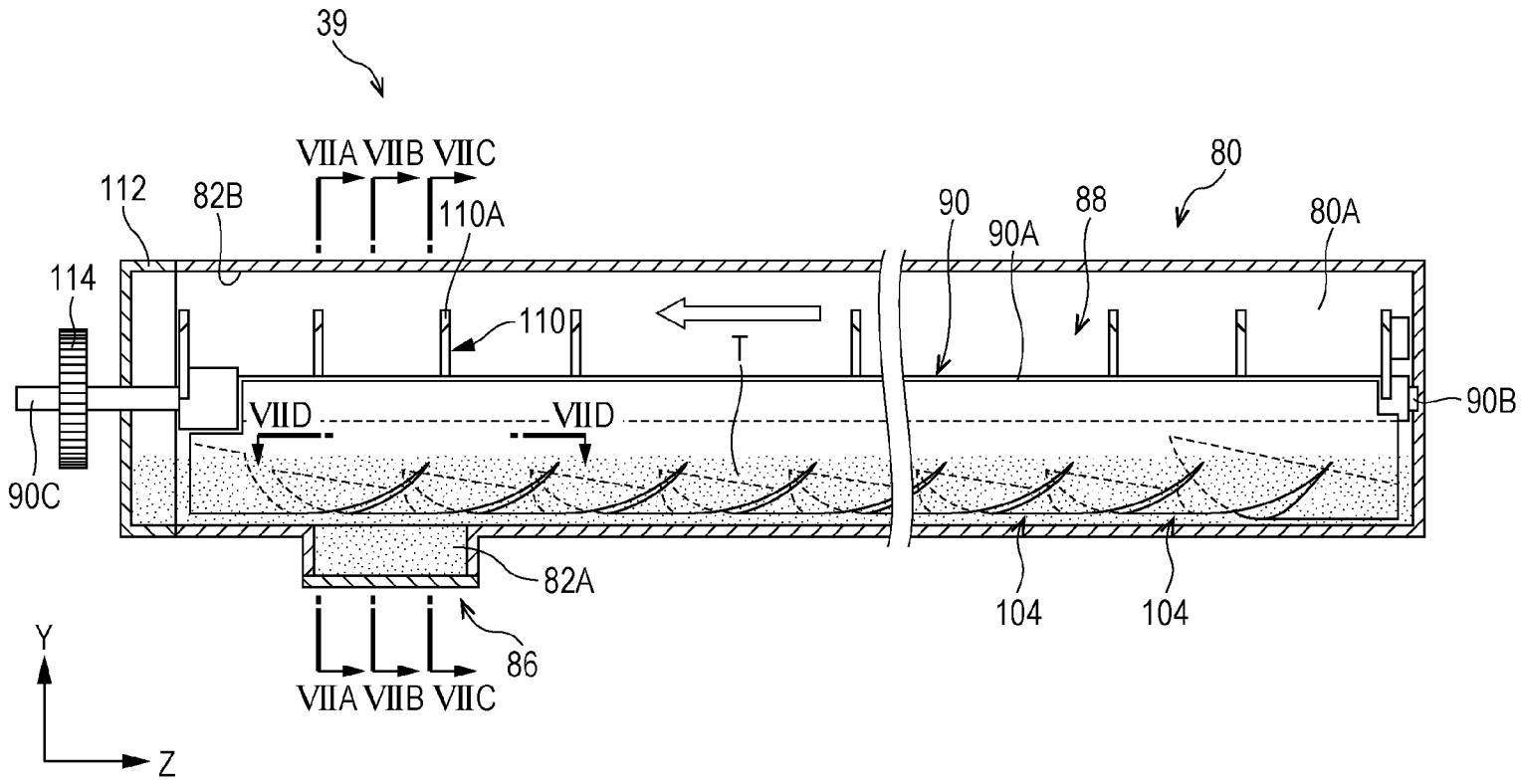
FIG. 2 is a side sectional view illustrating a state in which powder inside the powder container is transported by a contact member of the powder transport member according to the exemplary embodiment of the present invention.
Figure 3:
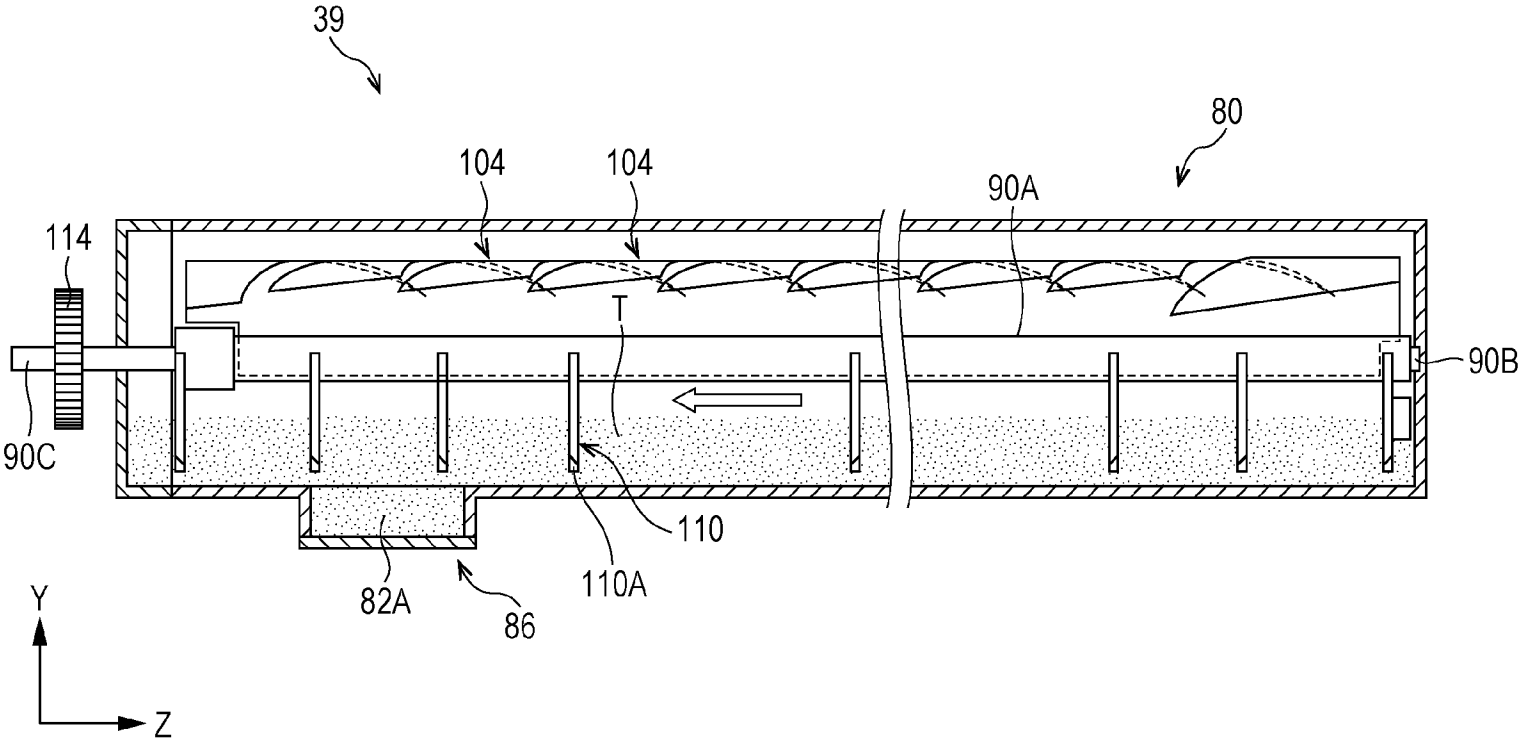
FIG. 3 is a side sectional view illustrating a state in which powder inside the powder container is agitated by projections of the powder transport member according to the exemplary embodiment of the present invention.

FIG. 7A is a sectional view of the vane part 104 taken along a line VIIA-VIIA of FIG. 2, FIG. 7B is a sectional view of the vane part 104 taken along a line VIIB-VIIB of FIG. 2, and FIG. 7C is a sectional view of the vane part 104 taken along a line VIIC-VIIC of FIG. 2. That is, the sectional view taken along the line VIIA-VIIA, the sectional view taken along the line VIIB-VIIB, and the sectional view taken along the line VIIC-VIIC are presented in order of decreasing distance of the distal end 104A of the vane part 104 from the proximal end of the vane part 104 in a direction opposite to the rotational direction of the rotary shaft 90 (to be hereinafter referred to as counter-rotational direction as appropriate). The term "the proximal end of the vane part 104" as used herein refers to the portion of the vane parts 104 which lies on the straight line connecting the end edges 102B of each two adjacent slits 102 of the transport member 100.

Consequently, the spring rate (stiffness) of the vane part 104 changes across these sectional views. With respect to the apparatus depth direction, the portion of the vane part 104 illustrated in FIG. 7A with the distal end 104A being located farthest from the proximal end among these sectional views, has a large curvature in comparison to the portion of the vane part 104 illustrated in FIG. 7B with the distal end 104A being located second farthest from the proximal end. Further, with respect to the apparatus depth direction, the portion of the vane part 104 illustrated in FIG. 7B with the distal end 104A being located second farthest from the proximal end among these sectional views, has a large curvature in comparison to the portion of the vane part 104 illustrated in FIG. 7C with the distal end 104A being located third farthest from the proximal end.

Figure 7D:
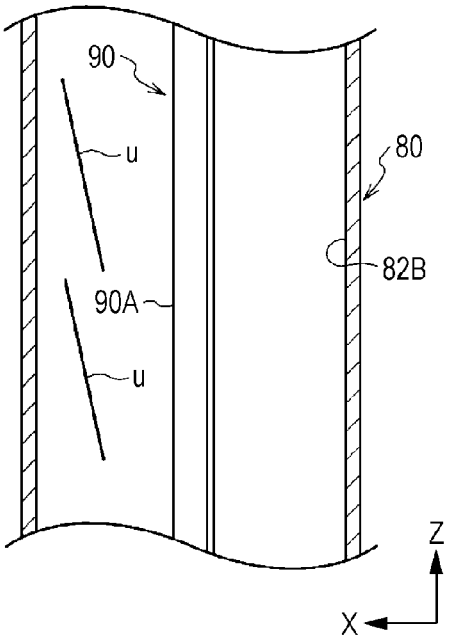
FIG. 7D is a sectional view (sectional view taken along a line VIID-VIID of FIG. 2) of the powder transport member taken along the axial direction, illustrating the tangent line between the distal end of the contact member and the inner wall of the container body.

As the curvature of the vane part 104 changes across these sectional views in the apparatus width direction, the contact point S between the distal end 104A of the vane part 104 and the inner wall 82B changes in the circumferential direction of the inner wall 82B. Consequently, as illustrated in FIG. 7D, the tangent line U formed by the contact points S in these sectional views is inclined with respect to the apparatus depth direction so as to diverge toward the downstream side in the toner transport direction (inclined in such a way that the toner T is transported downstream in the toner transport direction). Consequently, the toner T contained in the containing part 80A is transported by the vane parts 104 that rotate, toward the discharge opening 82A located at the downstream side in the toner transport direction of the container body 80 (see FIG. 2).

[Others]

As illustrated in FIGS. 4 and 5, the powder container 39 includes the closing member 112 that closes the cylindrical part 82 of the container body 80 from the downstream side in the toner transport direction. The closing member 112 is secured to a portion of the cylindrical part 82 which is located at the downstream side in the toner transport direction by a securing component (not illustrated). Further, the closing member 112 is provided with the through-hole 112A through which the shaft part 90C of the rotary shaft 90 penetrates.

Further, the powder container 39 includes a gear 114 secured to the portion of the shaft part 90C which is exposed to the outside from the through-hole 112A. In a state in which the powder container 39 is mounted on the first housing 12, the gear 114 and a gear (not illustrated) provided inside the first housing 12 are in meshing engagement with each other, allowing a rotational force to be transmitted to the rotary shaft 90 from a drive source (not illustrated) via the gear 114.

(Operation)

Next, operation of the powder transport member 88 and the powder container 39 according to the exemplary embodiment will be described by way of the process of transporting the toner T contained in the containing part 80A toward the discharge opening 82A.

When the toner T contained in the containing part 80A of the powder container 39 is to be transported toward the discharge opening 82A, a rotational force is transmitted via the gear 114 to the rotary shaft 90 of the powder transport member 88. As the rotary shaft 90 rotates, the agitating parts 110 also rotate. Consequently, the toner T contained in the containing part 80A is agitated.

Further, the rotation of the rotary shaft 90 also causes the transport member 100 to rotate. As the transport member 100 rotates, as illustrated in FIGS. 7A, 7B, and 7C, the vane parts 104 provided in the transport member 100 flex into a curved shape. Further, the tangent line formed between the distal end 104A of the vane parts 104 and the inner wall 82B is inclined so as to diverge toward the downstream side in the toner transport direction with respect to the apparatus depth direction. Consequently, as illustrated in FIG. 2, the toner T is transported toward the discharge opening 82A located at the downstream side in the toner transport direction.

Meanwhile, the toner T contained (depositing) at the upstream side in the toner transport direction of the containing part 80A is discharged toward the discharge opening 82A by the vane parts 104 provided in the transport member 100.

While a specific exemplary embodiment of the invention has been described above in detail, the above exemplary embodiment of the invention is not limitative but those skilled in the art will appreciate that various other exemplary embodiments are possible within the scope of the invention. For example, while in the above exemplary embodiment the toner T is contained in the containing part 80A of the powder container 39, a carrier or the like may be contained in the containing part 80A together with the toner T. Further, the powder to be transported is not limited to a carrier or toner. The exemplary embodiment of the invention may be employed for any application where it is desired to transport powder contained in a cylindrical containing part.

Figure 10:
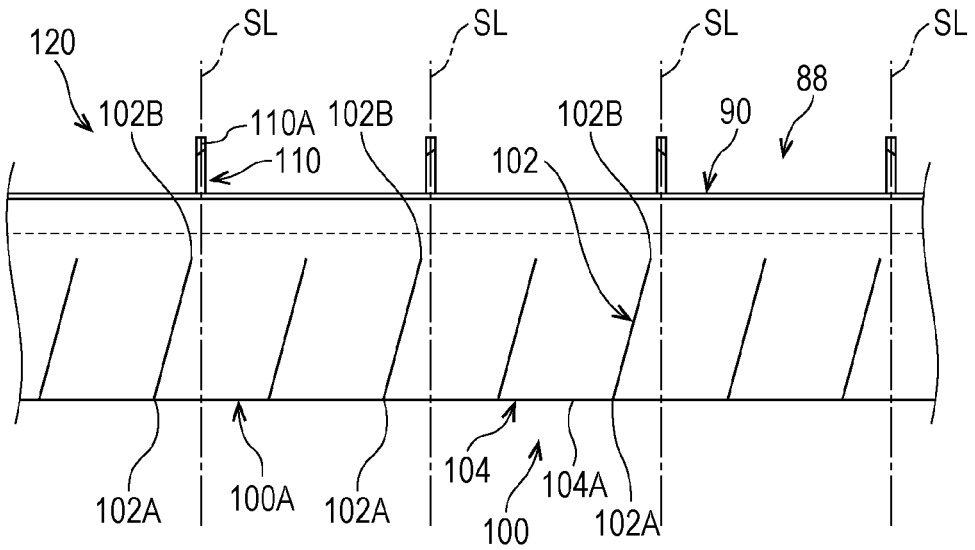
FIG. 10 is a side view of a modification of the powder transport member according to the exemplary embodiment of the present invention.

In the exemplary embodiment mentioned above, the slits 102 are provided in the transport member 100 in such a way that each two adjacent slits 102 partially overlap with respect to the rotational direction of the rotary shaft 90, the exemplary embodiment of the invention is not limited to this configuration. Like a powder transport member 120 according to a modification illustrated in FIG. 10, the slits 102 may be provided in the transport member 100 in such a way that each two adjacent slits 102 do not overlap with respect to the rotational direction of the rotary shaft 90. In this case as well, by disposing the agitating parts 110 on the rotary shaft 90 in such a way that the distal end portion 110A of the agitating parts 110 and the starting edge 102A of the slits 102 are located at different positions with respect to the axial direction, the same operational effect as that of the above exemplary embodiment is obtained.

Test Example

Next, to explain the effect of the exemplary embodiment of the invention, Tests 1 and 2 described below are conducted by use of a powder container using a powder transport member according to Example, and a powder container using a powder transport member according to Comparative Example. The powder transport member according to Example used for the testing is a powder transport member of the same configuration as the powder transport member 88 according to an exemplary embodiment of the invention, and the powder transport member according to Comparative Example is a powder transport member in which the distal end portion of the agitating parts and the starting edge of the slits of the transport member are located at the same position with respect to the axial direction of the rotary shaft.

Figure 11:
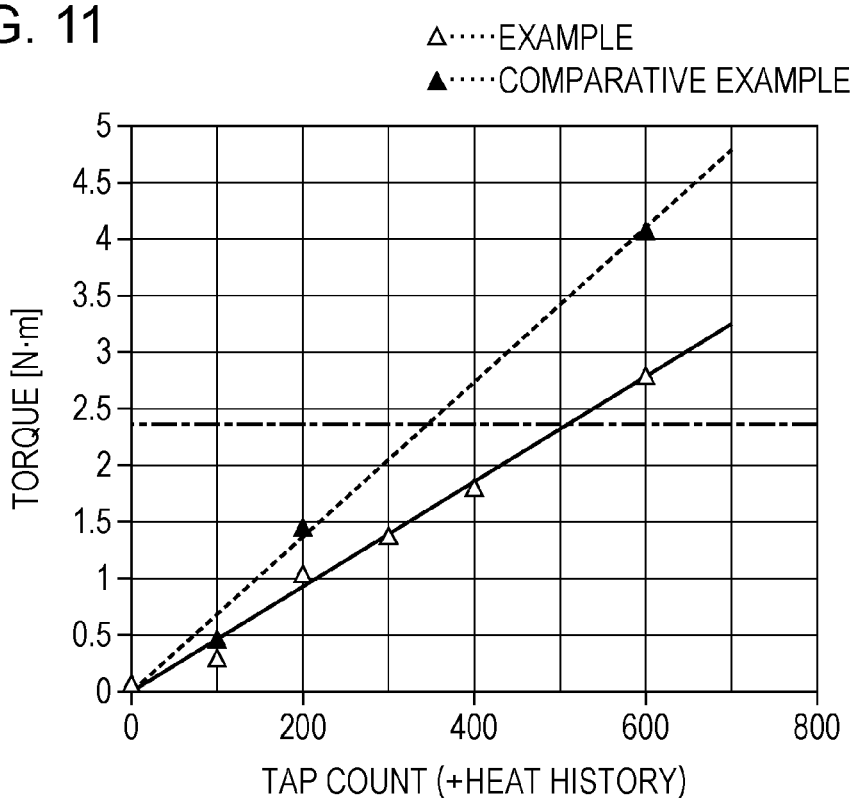
FIG. 11 is a graph illustrating the relationship between heat history and drive torque of a powder container using the powder transport member according to the exemplary embodiment of the present invention.

In Test 1, upward and downward taps (vibrations) are given a hundred times to the powder container according to Example and the powder container according to Comparative Example each containing 470 g of toner (including 100 g of carrier), followed by storage for 72 hours under the environment of a heat history of 48° C. and a humidity of 85%. Thereafter, each of the powder containers is attached to the image forming apparatus, and after continuous use, the torque on the powder transport member is measured. Further, the torque on the powder transport member is further measured while increasing the number of taps given to each of the powder container according to Example and the powder container according to Comparative Example by increments of one hundred. The results of these measurements are illustrated in FIG. 11.

In Test 2, upward and downward taps (vibrations) are given two hundred times to the powder container according to Example and the powder container according to Comparative Example each containing 470 g of toner (including 100 g of carrier), followed by storage for 72 hours under the environment of a heat history of 48° C. and a humidity of 85%. Thereafter, each of the powder containers is attached to the image forming apparatus, and after continuous use, the rate of toner discharge from each of the powder containers (in other words, the rate of toner supply to the developing unit), and the amount of toner remaining in each of the powder containers after use are measured. Measurements are also taken of the rate of toner discharge and the amount of remaining toner for a case where the powder container according to Example and the powder container according to Comparative Example are continuously used after being attached to the image forming apparatus, without subjecting the powder containers to neither the tapping nor environmental load mentioned above. The results of these measurements are illustrated in Table 1.

TABLE 1

| | Comparative Example | | Example | |
|---|---|---|---|---|
| Tap count (times) | 0 | 200 | 0 | 200 |
| Toner discharge (mg/s) | 525.8 | 285.2 | 485 | 467 |
| Remaining toner (mg) | 54 | 100 | 15 | 35 |

As illustrated in FIG. 11, the torque on the powder transport member according to Example is reduced by 30% in comparison to Comparative Example, and in terms of the number of taps with which a target torque can be achieved, this tap count increases from 350 to 500. This is assumed to indicate that in the powder transport member according to Example, the load exerted on the agitating parts is reduced by arranging the distal end portion of the agitating parts at a different position from the starting edge of the slits of the transport member with respect to the axial direction of the rotary shaft.

Further, as illustrated in Table 1, in Comparative Example, the agitating parts fails to successfully break agglomeration of toner due to the tapping and heat history, with the result that a sharp decrease in the rate of toner discharge and a sharp increase in the amount of remaining toner are observed. The results according to Example, however, are more stable in these respects, with only a slight change in both the rate of toner discharge and the amount of remaining toner. This improved stability in terms of the rate of toner discharge and the amount of remaining toner according to Example over Comparative Example results from the difference regarding the presence of damage to the transport member in the portion where interference (contact) occurs between the transport member and the agitating parts and the presence of twisting of the rotary shaft. That is, in Comparative Example, bending of the transport member, and slight twisting of the rotary shaft are observed, whereas in Example, hardly any changes are observed. From these results, it is assumed that in Comparative Example, transport performance decreases owing to damage to the transport member and twisting of the rotary shaft which are caused by an increase in torque after tapping, resulting in a decrease in the rate of toner discharge and an increase in the amount of remaining toner, whereas in Example, an increase in torque is reduced, thereby minimizing a decrease in the rate of toner discharge and an increase in the amount of remaining toner.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder transport member comprising:

a rotary member configured to rotate around an axis inside a container in which powder is contained;

a contact member comprising:

a first end secured to the rotary member; and a second end opposite from the first end that is a free end, the contact member flexing upon contact of the second end with an inner wall of the container, the contact member having a plurality of cuts provided along an axial direction of the rotary member, the plurality of cuts and extending from the second end obliquely with respect to a radial direction of the rotary member toward the first end; and a plurality of projections provided on the rotary member along the axial direction, the plurality of projections projecting from the rotary member toward the inner wall of the container, the plurality of projections comprising a first projection, wherein the plurality of cuts comprises:

a first cut; and a second cut provided adjacent to the first cut without an additional cut provided between the first and the second cuts, and wherein the first projection is provided between a starting edge of each of the first and the second cuts.

2. The powder transport member according to claim 1, wherein the plurality of projections further comprises a second projection, wherein the plurality of cuts further comprises:

a third cut; and a fourth cut, the first, second, third and fourth cuts sequentially arranged along the axial direction of the rotary member, and wherein the second projection is provided between a starting edge of each of the third and the fourth cuts.

3. The powder transport member according to claim 1, wherein the first cut comprises an end edge being provided opposite to the starting end of the first cut, and wherein the first projection is offset along the axial direction of the rotary member from the starting and end edges of the first cut and the starting edge of the second cut.

4. The powder transport member according to claim 1, wherein a length of each of the plurality of cuts in the radial direction of the contact member is greater than a half of a width of the contact member in the radial direction.

* * * * *